US005806826A

United States Patent [19]

Lemire

[11] Patent Number: 5,806,826

[45] Date of Patent: Sep. 15, 1998

[54] PICTURE HANGER

[76] Inventor: Robert Lemire, 21 Carriage Dr., Kings Park, N.Y. 11754

[21] Appl. No.: 630,878

[22] Filed: Apr. 2, 1996

Related U.S. Application Data

[63] Continuation-in-part of Ser. No. 346,511, Nov. 29, 1994, abandoned.

[51] Int. Cl.[6] ..... A47G 1/24

[52] U.S. Cl. ..... 248/476; 248/495

[58] Field of Search ..... 248/493, 494, 248/495, 496, 480, 489, 466, 475.1, 476, 320, 328

[56] References Cited

U.S. PATENT DOCUMENTS

| | | | |
|---|---|---|---|
| 1,107,686 | 10/1914 | Mehrmann | 248/495 |
| 1,433,178 | 10/1922 | Chase | 248/495 |
| 2,522,901 | 9/1950 | Schrager et al. | 248/495 |
| 2,681,194 | 6/1954 | Halvorsen | 248/495 |
| 2,697,572 | 12/1954 | Pfankuch | 248/495 |
| 2,877,972 | 3/1959 | Sutton et al. | 248/493 |
| 2,939,661 | 6/1960 | Waller et al. | 248/495 |
| 3,251,569 | 5/1966 | Rynearson | 248/495 |
| 4,566,665 | 1/1986 | Rynearson | 248/495 |
| 4,775,129 | 10/1988 | Gleisten | 248/493 |
| 4,892,284 | 1/1990 | Kelrick | 248/476 |
| 5,069,411 | 12/1991 | Murphy | 248/495 X |
| 5,224,238 | 7/1993 | Warner et al. | 248/289.11 X |
| 5,437,429 | 8/1995 | Atlas | 248/493 |
| 5,441,230 | 8/1995 | Sambleson | 248/495 |

FOREIGN PATENT DOCUMENTS

| | | | |
|---|---|---|---|
| 2221616 A | 2/1990 | United Kingdom | 248/476 |

*Primary Examiner*—Ramon O. Ramirez
*Attorney, Agent, or Firm*—Meltzer, Lippe, Goldstein, et al.

[57] ABSTRACT

An improved picture hanger has a plate, a screw, and a moveable adjusting hook. The plate comprises a set of upwardly directed wire supports, and a top and a bottom screw support. The screw extends through the top and bottom screw supports. The adjusting hook has a threaded opening which meshes with the threads. This allows the hook to move up and down along the screw when the screw rotates. This picture hanger may include openings or supports to affix a picture light or a safety wire. The plate is affixed to a desired location on a wall. This location need not be precisely measured for height. A support wire is placed in open portions upwardly directed wire supports. The wire is also placed in an open portion of the downwardly directed adjusting hook. This places the wire into an "M" shape after the picture hanging device is affixed to the wall. If the object to be hung is not at the desired height, the height may be adjusted by turning the screw, which raises or lowers the object. The picture hanger may also provide side-to-side adjustability by moving the horizontal position of one of the upwardly directed wire supports.

19 Claims, 8 Drawing Sheets

FIG. 8
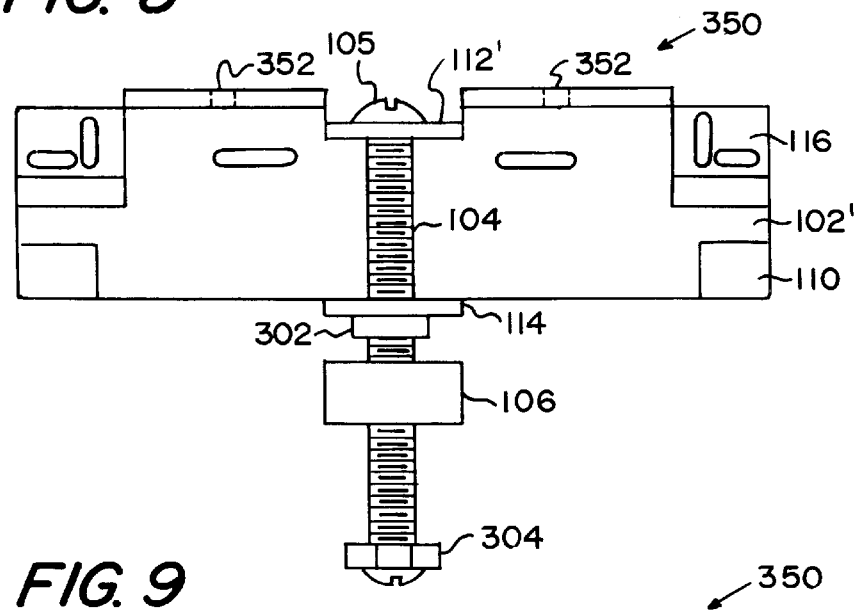
FIG. 9
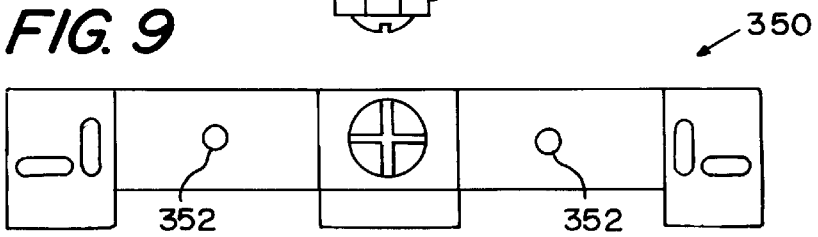
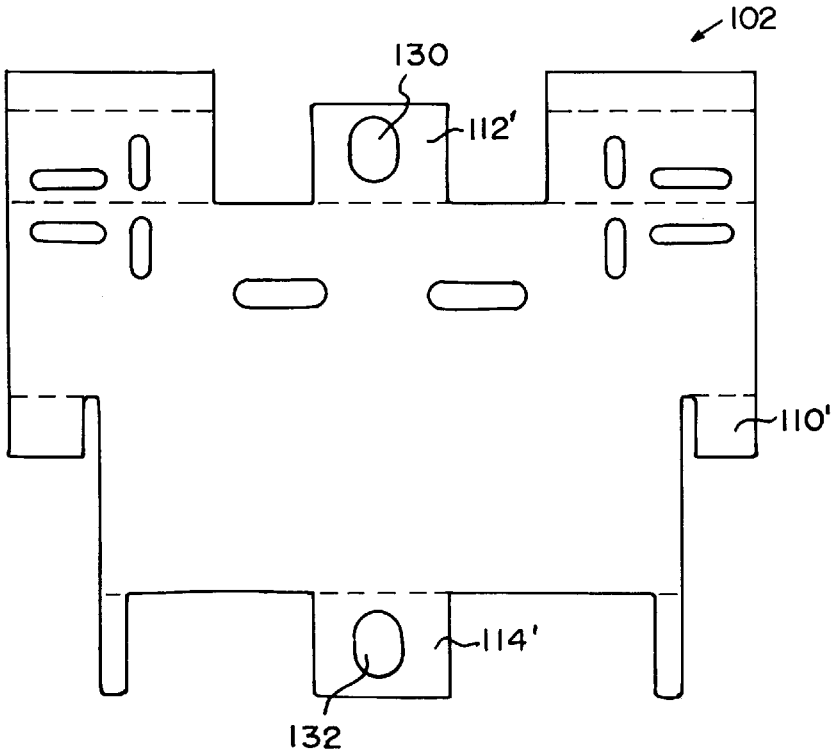
FIG. 5

FIG. 18
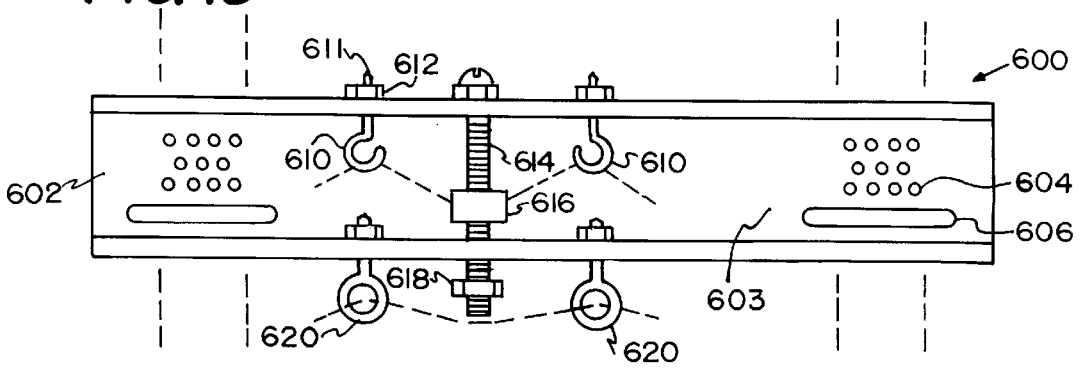
FIG. 21
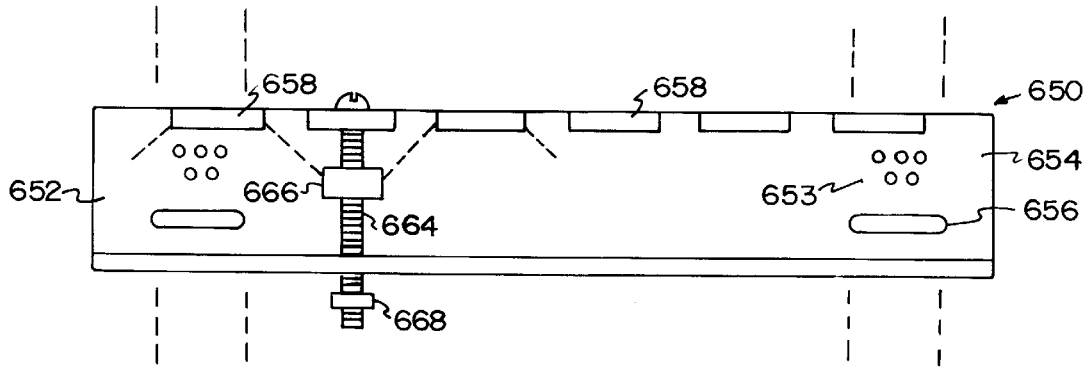
FIG. 22
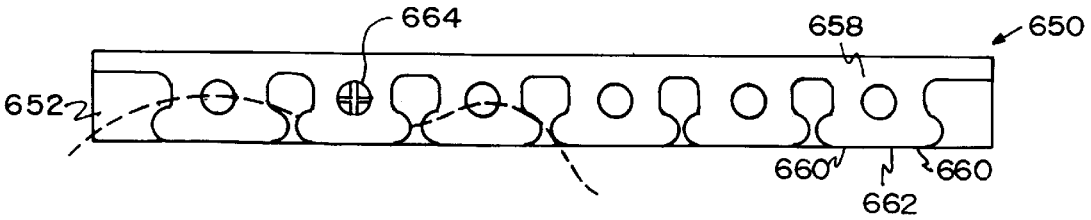
FIG. 20
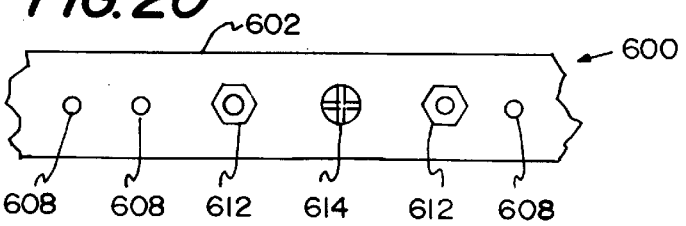
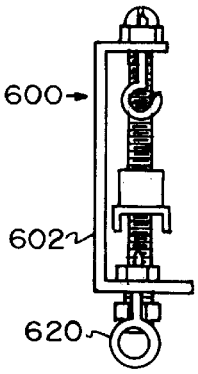
FIG. 19

PICTURE HANGER

RELATED APPLICATION

This is a continuation-in-part of patent application Ser. No. 08/346,511, filed on Nov. 29, 1994 now abandoned. The contents of that application are incorporated herein by reference.

FIELD OF THE INVENTION

The present invention relates to a device for hanging pictures or objects on a wall and, more particularly, to an improved picture hanging device.

BACKGROUND OF THE INVENTION

Objects such as framed art work, mirrors, photographs, diplomas, and the like are typically hung on a wall by hammering one or two nails or hooks into the wall, and supporting the picture on the nail(s) or hook(s) by a wire or string attached to the object. If a single nail or hook is used, the object may tilt due to non-uniform weight distribution, vibrations, persons bumping into it, and other reasons. Using two nails or hooks provides additional stability.

Hanging an object at a desired height and/or location is not as simple as just hammering the hooks into the wall. To hang the object at a desired height, the hooks must be properly positioned with respect to the wire. This height must take into consideration where on the sides of the object the wire is connected, how far the object drops when the wire is hung on the hooks, and how far apart the hooks are from each other.

With either the one or two nail or hook arrangement, once nailed into the wall, adjusting the height or side-to-side position of the object is difficult. Either the wire must be shortened (to change the height) or the hooks or nails must be nailed into a new location in the wall (to change the height and/or the side-to-side location). This has several drawbacks. First, it is time consuming; one may have to re-measure the hooks to make sure that they at the proper height and proper distance apart. Second, it requires a second set of holes in the wall—this is particularly undesirable if the first set of holes is visible due to the new location of the object. Third, for heavy objects (such as mirrors or large paintings), the hooks or nails are preferably nailed into studs behind sheetrock walls to properly secure the nails or hooks to the wall. This then establishes the center of the picture as being located midway between the studs.

After the nail or hooks are affixed in the walls, the wire on the object must be positioned over them. This procedure is difficult, particularly for large objects. This is because it is undesirable for the wire to show above the object. Thus, the wire length is selected to be short to not extend over the top of the object when pulled up. This short wire provides little room behind the object to position the wire into the hooks. This procedure typically must done "blind", using one's "feel", rather than sight, to position the wire.

Another disadvantage to the conventional arrangement is that the nail or hook and wire arrangement does not provide any protection against accident or theft. For example, if the wire supporting the object breaks or disconnects from the object, it will fall and possibly be damaged, not to mention damage that may occur to persons or objects beneath it. A particularly valuable object is not protected from theft—a thief having access to the object may take it off the wall simply by lifting it off of the hooks or nails.

On the other hand, as a practical matter, picture hangers must be economical to manufacture. Most persons do not want to spend more than a few cents to a few dollars on a picture hanger. A typical set of hooks for hanging a picture is quite inexpensive. Thus, even if a picture hanger overcame the drawbacks discussed, it may not be a successful product if it is overly expensive to manufacture. Few, if any, people will buy a picture hanger costing significantly more than a hook, which is relatively inexpensive. Thus, an economical design is an advantageous feature of a picture hanger.

The prior art has attempted, unsuccessfully, to overcome these drawbacks and practical restraints. U.S. Pat. No. 3,251,569 to Rynearson discloses a picture hanger having vertical height adjustability by providing a threaded shaft which moves a block up and down with respect to fixed apertures or bosses on either side of the block. A support wire is attached to one end of the object to be hung, threaded through one boss, then through the block, and then through a second boss on the other side of the block. This is difficult to use for two reasons. First, the support wire on the object, which typically is attached to the sides of the object when purchased, must be removed from one side of the object, threaded through the bosses or apertures, and attached to the other side of the object. This is difficult to accomplish with limited space between the wall and the back of the object. Second, this arrangement is inconvenient because the picture hanger must be attached to the object before it is nailed into the wall. Thus, the object is in the way when the hanger is to be nailed to the wall. These features make it difficult or impossible to attach the object to the device and the device to the wall. The picture hanger is configured to "lock" the wire into place when adjusted. Thus, if the object is not level after adjusting the height, the block must be returned to its initial position, the wire adjusted, and then the block is readjusted to the desired height. This is both time consuming and inconvenient. Also, the picture hanger design is complex and expensive to manufacture.

U.S. Pat. No. 4,892,284 to Kelkrick discloses a picture hanger having both height and side-to-side adjustment. The picture hanger has a single point support that does not provide the stability of a multi-point support. A specially adapted tool similar to a socket wrench is required to adjust the hanger. Also, the side-to-side adjustability is achieved by moving the entire height adjustment mechanism from side to side. Thus requires the entire mechanism to move in a rack and gear or pinion arrangement. The overall structure of the picture hanger is complicated and relatively expensive to manufacture.

U.S. Pat. No. 2,877,972 to Sutton, et al. discloses a picture hanger having a centrally located tongue which may have a number of detents. On sides of the hanger are one or more hooks located even with or higher than the detents. A support wire is strung through the hooks and detents. Height adjustability may be made by changing the hooks or detent through which the wire passes. The adjustability of this device is limited—the height differences may only be made in increments based on the distance between detents or hooks. Slight changes in height are not possible. To change the height of the object, it must be taken off the wall in order to string the wire through a different detent or set of hooks. Also, it may be difficult to have the support wire "catch" the desired detent or hook because the picture hanger is already affixed to the wall. Also, the space between the picture and the wall is cramped. The second connection is a "blind" connection which relies on "feel", not sight, to be made. The object must be held while, at the same time, the wire must be manipulated in order to place it in the desired location.

U.S. Pat. Nos. 4,566,665 to Rynearson; 2,697,572 to Pfankuch; 5,441,230 to Sambleson; 2,522,901 to Schrager, et al.; 2,939,661 to Waller, et al.; and 2,681,194 to Halvorsen; and U.K. document No. 2,221,616A all disclose picture hangers having a single point support that does not provide the stability of a multi-point support.

U.S. Pat. No. 1,107,686 to Mehrmann discloses a device for hanging a picture from a picture molding, which is typically found near the ceiling of rooms having plaster walls.

Therefore, it is an object of the present invention to provide an easy-to-use picture hanger having height adjustability.

It is a further object of the present invention to provide a picture hanger having side-to-side adjustability.

It is an even further object of the present invention to provide a picture hanger having height and side-to-side adjustability that may easily be adjusted with a screwdriver or other household tool while the object is hanging on the wall.

It is yet a further object of the present invention to provide a convenient method of hanging an object that provides sufficient vertical adjustability so that the object may initially be hung lower than location of the hanger, thus providing full view installation of the wire onto the hanger.

It is yet another object of the present invention to provide a picture hanger that securely affixes to a wall to safely hang heavy or large objects.

It is yet a further object of the present invention to provide a picture hanger that provides improved security from damage or theft.

It is an even further object of the present invention to provide a picture hanger having an economical design.

SUMMARY OF THE INVENTION

These and other objects of the invention are achieved by the picture hanger according to the present invention.

One embodiment of the improved picture hanger has a plate, a screw, and a moveable adjusting hook. The plate comprises a set of upwardly directed wire supports, and a top and a bottom screw support. The screw extends through the top and bottom screw supports. The adjusting hook has a threaded opening which meshes with the threads. This allows the hook to move up and down along the screw when the screw is turned. The screw preferably has a slotted locking nut at its end. This picture hanger may include openings or supports to affix a picture light or a safety wire.

The plate is affixed to a desired location on a wall. This location need not be precisely measured for height. In a preferred embodiment, the location need not be precisely measured for center location either. A support wire is placed in open portions of the upwardly directed wire supports. The wire is also placed in an open portion of the downwardly directed adjusting hook. This places the wire into an "M" shape after the picture hanging device is affixed to the wall. If the object to be hung is not at the desired height, the height may be adjusted by turning the screw, which raises or lowers the object by altering the depth of the center portion of the "M". The screw head may be accessed from above the object and the optional slotted locking nut may be accessed from below the object. The object height may be adjusted without taking the object down; nor does the object have to be pulled away from the wall to get behind it.

The inventive picture hanger preferably has horizontally oriented slots in the plate for receiving wall fasteners such as nails or screws. This provides a degree of side-to-side adjustability by moving the plate with respect to the already affixed wall fasteners, thus adjusting the center location.

Another embodiment of the present invention is a picture hanger having both height and side-to-side adjustability without removing the object from the picture hanger. The picture hanger may have a configuration similar to that described above, except instead of having two upwardly directed wire supports, the plate has only one. Opposite the side having the wire support is a side adjustability mechanism. The side adjustability mechanism includes a horizontal screw, first and second screw supports, and an adjustable wire support, which is preferably threaded. Turning the screw moves the adjustable wire support right or left, thus changing the location where one "leg" of the "M" which is formed so that distance between the two wire supports changes. Because the midpoint between the two wire supports is always the object's center, changing the distance between the wire supports changes the location of the object's center.

Another preferred picture hanger according to the present invention includes a plate having a set of upwardly directed wire supports, and a bottom support. The bottom support includes two string receptacles and an aperture. The aperture has a wide portion and a narrow portion. The picture hanger also includes a string or wire which connects to the support wire. This string has a hook at one end and a grommet, ball, knot or other device at the other end. This retains the string in the bottom support aperture.

This picture hanger is preferably used in the following manner. The plate is affixed to the wall and centered (using the horizontal slots as above). The support wire is placed into the upwardly directed wire supports. Holding the object away from the wall, the hook of the string is connected to the wire at a location between the wire supports. The other end of the string is placed through the wide portion of the aperture. The string is pulled, thus pulling down the center of the wire and raising the object. When the object is at a desired height, the string is pulled into the narrow portion of the aperture. The string extending below the bottom support is wound around the bottom support using the string receptacles. This holds the string in place. Alternatively, the string may be pulled, wrapped around the receptacle, and when at the desired length (e.g., the object is at the desired height) the grommet is inserted into the wide portion of the aperture and pulled into the narrow portion to retain it in place. In either of these alternatives, the support wire may be sufficiently long to extend over the top of the object when pulled up. This permits the support wire to be inserted easily into the wire supports. This also provides sufficient slack so that the object may easily be pulled away from the wall, providing a user with room to pull down and connect the string.

Another preferred picture hanger according to the present invention is a picture hanger having a plate with a set of upwardly directed wire supports. The picture hanger also includes a string which connects to the support wire. This string has a hook at one end and preferably has a clasp or other fastening device at the other end. The string may be wrapped around an anchor which may be connected to the wall or the back of the object and has a lip, tongue, or flange.

To use this picture hanger, the string is hooked to the support wire, wrapped around the lip, flange, or tongue of the anchor as many times as desired until the string is at a desired length (e.g., the object is at the desired height). The end of the string is then tied or clipped to itself using the fastening device.

Another preferred picture hanger according to the present invention includes a support bar and a picture hanger. The support bar may be affixed to two (or more) studs in the wall.

The top back portion of the bar has a recess. The picture hanger is similar to those described above. However, the picture hanger has a tongue or flange which mates with the recess in the bar. The recess/tongue arrangement allows the picture hanger to be located on any horizontal location on the bar. Thus, large or heavy objects may be secured to studs in the wall, yet be positioned at locations not centered between the studs.

Yet another preferred picture hanger according to the present invention has a U-shaped channel which may be affixed to two (or more) studs. The channel has a web portion which preferably has slotted holes for side adjustability. Top and bottom sections of the channel have a number of holes. These holes are adapted to receive hooks or eyes having a threaded portion for fastening to a nut, or a screw having an adjustable hook. Additional hooks or eyes may be connected as optional safety hooks. Because the top and bottom section holes are located at various locations on the channel and the web preferably has slotted holes, a picture hanger made of the hooks, screw, and adjustable channel may have an object hung from it located at any location between the studs. This allows large or heavy objects to be secured to studs in the wall, yet be positioned at locations other than centered between the studs.

Yet another preferred picture hanger according to the present invention has a U-shaped channel which may be affixed to two (or more) studs. The channel has a web portion which preferably has slotted holes for side adjustability. The top of the channel has a number of projections and holes, while the bottom preferably has only holes. These projections may have holes adapted to receive a screw having an adjustable channel. The combination of the slotted holes in the web and the projections at various locations on the channel, a picture hanger made of the holes, projections, and the screw and adjustable channel may have an object hung from it located at various locations. This allows large or heavy objects to be secured to studs in the wall, yet be positioned at locations other than centered between the studs.

The inventive device may also be used to raise the height of an already-hung object by tightening the support wire. The inventive device may also be adapted for use as a shock absorber for wires, rope, and the like by connecting a compressible bias, such as a spring, to the movable hook.

Each of these embodiments is economical to manufacture and easy to use.

BRIEF DESCRIPTION OF THE DRAWINGS

The present invention is described with reference to the following figures:

FIG. 5 is a front view of a single sheet of material which may be stamped into the picture hanger of FIG. 1;

FIG. 8 is a front view of a third embodiment of a picture hanger according to the present invention;

FIG. 9 is a top view of the picture hanger of FIG. 8;

FIG. 18 is a front view of an eighth embodiment of a picture hanger according to the present invention;

FIG. 19 is a side view of the picture hanger of FIG. 18;

FIG. 20 is a top view of a portion of the picture hanger of FIG. 18;

FIG. 21 is a front view of a ninth embodiment of a picture hanger according to the present invention;

FIG. 22 is a top view of the picture hanger of FIG. 21;

DETAILED DESCRIPTION OF PREFERRED EMBODIMENTS

Figure 1:
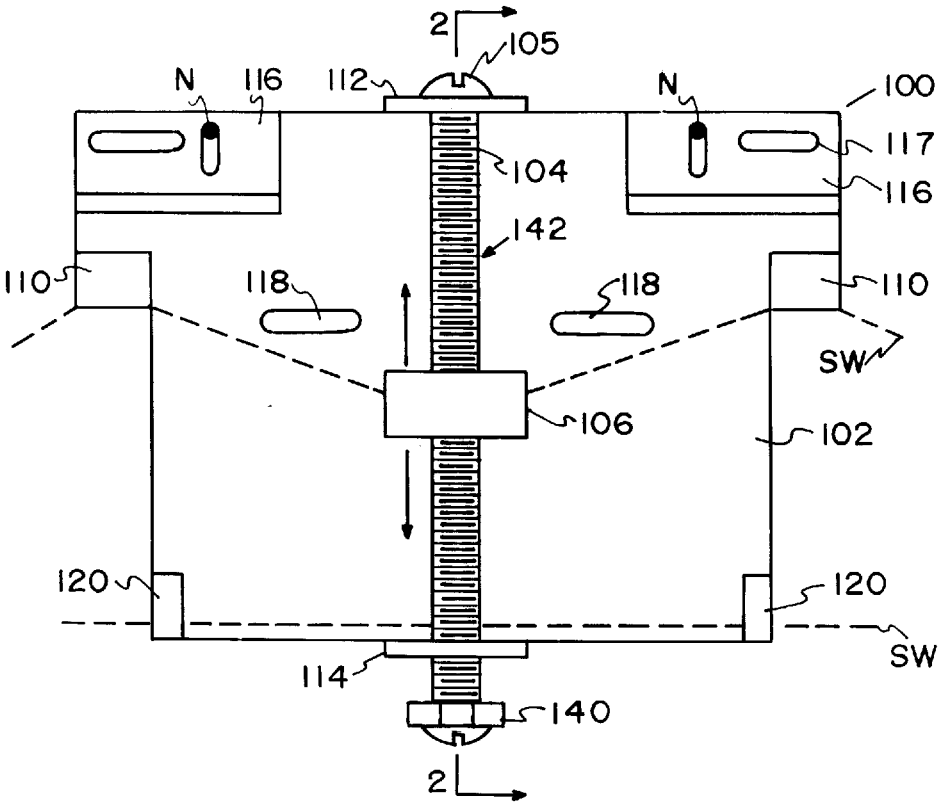
FIG. 1 is a front view of a first embodiment of a picture hanger according to the present invention.
Figure 2:
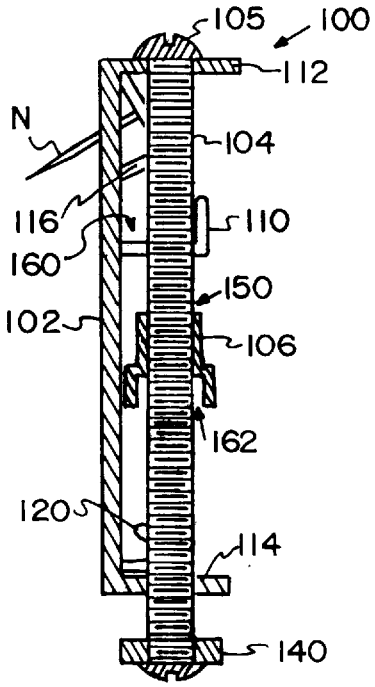
FIG. 2 is a cross-sectional view of the picture hanger of FIG. 1 taken along line 2—2.
Figure 3:
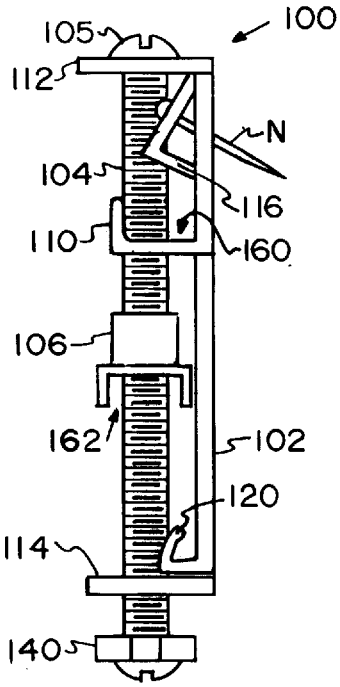
FIG. 3 is a side view of the picture hanger of FIG. 1.

FIGS. 1, 2, and 3 illustrate a first preferred picture hanger 100 according to the present invention. The picture hanger comprises a plate 102, a screw 104, and a moveable adjusting hook 106.

The plate 102 comprises a set of upwardly directed wire supports 110, a top screw support 112, a bottom screw support 114, one or more fastening brackets 116 or apertures 118, and optional safety hooks 120. The brackets 116 preferably have at least one horizontally oriented slot 117 for providing side-to-side adjustability after being affixed to the wall. The apertures 118 may receive molly bolts or other fasteners and are also preferably horizontally oriented slots to provide side adjustability.

The screw 104 extends through apertures 130, 132 (see FIG. 5) in the top and bottom screw supports 112, 114. At one end of the screw is a slotted screw head 105. At some location on the screw 104 is a locked nut 140. The nut may be locked, for example, by crushing the screw's threads 142 at the location of the nut. Preferably, the locked nut is a slotted castle nut, as seen in FIG. 1. The adjusting channel has a threaded opening 150 (FIG. 2) which meshes with the threads 142, which allows the hook 106 to move up and down along the screw 104 when the screw is turned.

The picture hanger 100 operates as follows. The plate is affixed to a desired location on a wall using, for example, a nail N which extends through the slotted openings 117 in the fastening brackets or apertures 118. This location need not be precisely measured for height or horizontal position. A support wire (illustrated in FIG. 1 with a dashed line and labeled "SW") is placed in the open portion 160 of the upwardly directed wire supports 110. The wire is also placed in the open portion 162 of the downwardly directed adjusting hook 106. This places the wire into an "M" shape.

Figure 4A:
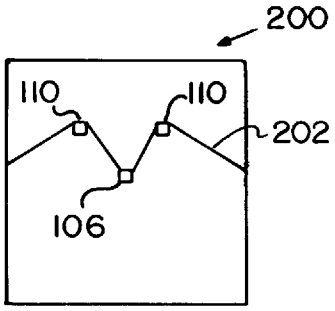
FIGS. 4A, 4B, and 4C illustrate the operation of the present invention.
Figure 4B:
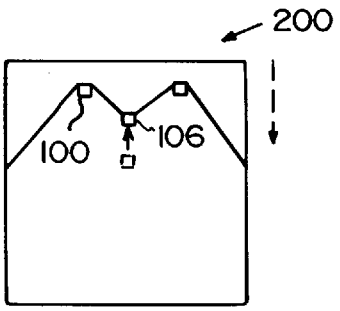
Figure 4C:
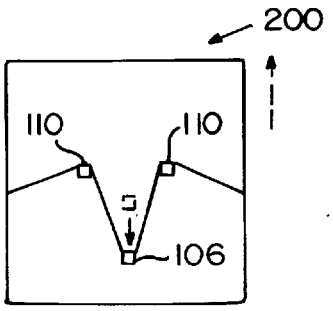

If the object to be hung is not at the desired height, the height may be adjusted by turning the screw 104. The screw may be accessed from above the object by using, for example, a screw driver to turn the screw head 105. The screw may be accessed from below the object by turning the slotted castle nut 140 with either a screw driver, socket wrench, or ratchet. There is no need to take the object down for vertical adjustment from the wall. FIGS. 4A–4C illustrate the operation of the invention. FIG. 4A illustrates an object 200 having a wire 202 in the inventive picture hanger 100 at a first height. The wire 202 has, of course, a fixed length and is connected to fixed points towards the edges of the object.

Turning the screw in one direction (i.e., clockwise) causes the height of the object to drop. This is because turning the screw in that direction causes the adjusting hook 106 to move up. This causes the center portion of the "M" (formed by the adjusting hook 106) to become shorter. This, in turn, causes the outside "legs" of the "M" (formed by the upwardly directed wire supports 110) to become longer. The ends of the "legs" are connected to the object. As seen in FIG. 4B, lengthening the "legs" causes the height of the object to drop.

Turning the screw in the opposite direction (i.e., counterclockwise) causes the height of the object to rise. This is because turning the screw in that direction causes the adjusting hook to move down. This causes the center portion of the "M" to become longer. This, in turn, causes the outside "legs" of the "M" to become shorter. As seen in FIG. 4C, shortening the "legs" causes the height of the object to rise.

Figure 4D:
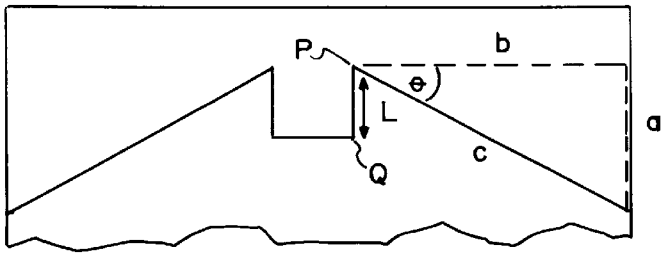
FIGS. 4D and 4E compare the degree of adjustability of a prior art device and the present invention.
Figure 4E:
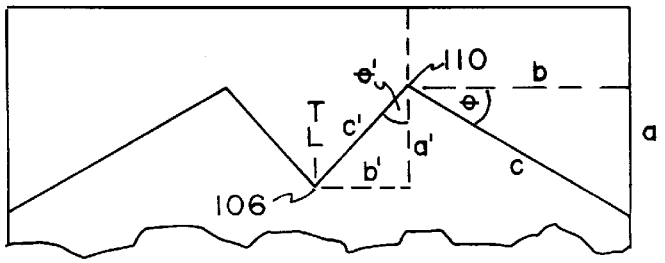
(PRIOR ART) FIG. 4E

FIGS. 4D and 4E compare the amount of height adjustability between the device disclosed in U.S. Pat. No. 3,251,569 to Rynearson (discussed above) and the present invention. As seen in FIG. 4D, the configuration disclosed in the Rynearson patent creates a right triangle having sides a, b, and c. Side c is formed by the support wire extending from the device to the side of the object. If a=6" and b=10", then c is determined by $a^2+b^2=c^2$ and c=11.662". If the length L is increased by 1" (the block is lowered 1"), the change in height (i.e., the change of side a) may be determined by the following equation:

$$a = \sqrt{(10.66)^2 - (10)^2} = 3.698 \text{ inches}$$

Note that the angle between points P and Q in FIG. 4D is essentially 90° and therefore a 1" increase in L results in a 1" change in c. Thus, a 1" increase in L raises the object (6"–3.698")=2.302" in height. On the other hand, if L is decreased by 1" (the block is raised 1", adding 1" to the length of c), the height difference may be determined by:

$$a = \sqrt{(12.662)^2 - (10)^2} = 7.676 \text{ inches}$$

Thus, a 1" decrease in L results in a 7.767"–6"=1.767" lowering of the object.

Referring to FIG. 4E, the configuration according to the present invention creates two right triangles. The first right triangle (sides a, b, c) is defined between the side of the object and the wire support 110. The second right triangle (sides a', b', c') is defined between the wire support 110 and the hook 106. Assume that a=6", b=10", a'=2", and b'=2". A change in L changes a, a', c and c'; b and b' do not change. Using $a^2+b^2=c^2$, c and c' are 11.662" and 2.83" respectively. Increasing (lowering) L by one inch makes a'=3 inches. Side c' is now 3.606" and the change in its length is 3.606"–2.83"=0.776". Side c is now =11.662"–0.776"=10.8865". The length of side a may be determined by:

$$a = \sqrt{(10.8865)^2 - (10)^2} = 4.303 \text{ inches}$$

The change in side a is 6"–4.303"=1.697". When L is decreased (raised) by 1", the change in side a is 1.086".

Thus, the inventive arrangement has a more gradual height change in relation to the change of the center hook. This results in an easier adjustment for a desired height. Also, in the inventive arrangement, the wire is not "locked" into position when the height is adjusted, as is true with the Rynearson device. The present invention permits the wire to slide with relation to the wire supports and hook if moved by the user, even when the height has been adjusted. This overcomes a drawback in the Rynearson device which requires the height adjustment to be returned to its original position before the wire can be adjusted.

The optional safety hooks 120 may receive a second wire (labeled "safety wire" in FIG. 1) connected to the object. This wire may provide additional safety in the event that the first wire breaks. This may be particularly useful for heavy objects or in earthquake prone areas. The safety hooks may also serve an anti-theft function. The safety hooks may be crimped closed, using, for example, a pliers, to "lock" the object onto the picture hanging device 100, which is fastened to the wall. Additional security may be obtained by placing this safety wire between the screw 104 and the plate 102.

FIG. 5 illustrates the economical design of the picture hanger of FIG. 1. The plate 102 consists of a single sheet of material which may be stamped or otherwise folded or bent into the proper configuration. The dashed lines indicate where the sheet is to be folded. For example, to form the upwardly directed wire supports 110, the tab 110' of material is bent upward. To form the top and bottom screw supports, 112, 114, the tabs 112' and 114' are folded to a 90° angle with respect to the plate 102.

The screw is free to rotate in the apertures 130, 132. The locked nut 140 prevents the screw from falling out or being removed from the apertures and allows the screw 104 to be accessed from below the object while hanging.

Figure 6:
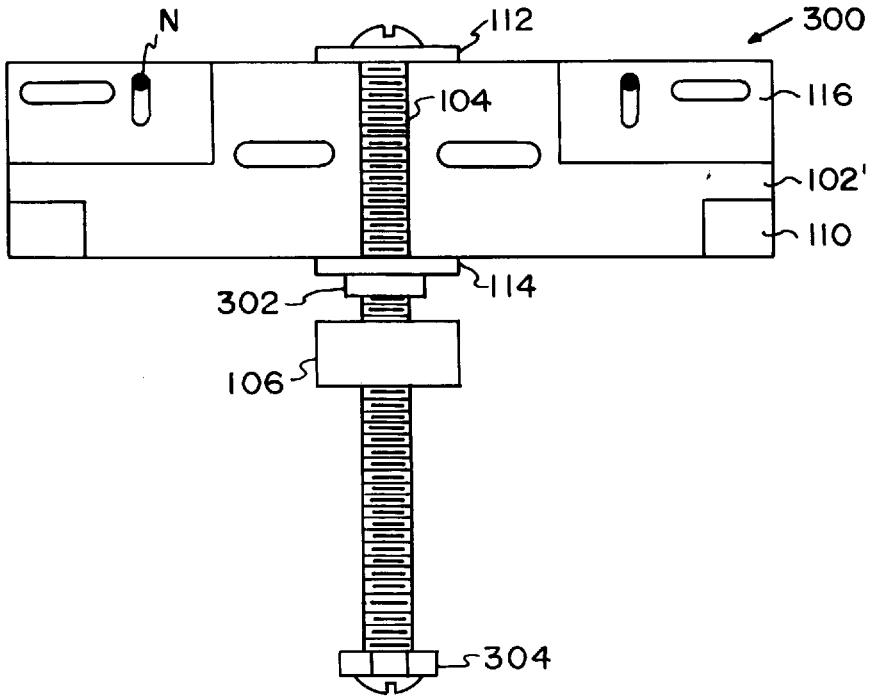
FIG. 6 is a front view of a second embodiment of a picture hanger according to the present invention.

FIG. 6 illustrates a second preferred picture hanger 300 according to the present invention. The picture hanger comprises a plate 102, a screw 104, and a moveable adjusting hook 106. This picture hanger is similar to the one shown in FIG. 1. This embodiment is more economical to make because the amount of sheet material is greatly reduced. In this embodiment, the adjusting hook 106 is located below the plate 102. The plate 102 is not between the adjusting hook 106 and the wall. Note that in this embodiment, two locked nuts 302, 304 are preferred. The first nut 302 retains the screw 104 between the top and bottom supports 112, 114. The second nut 304 prevents the adjusting hook 106 from falling off of the screw 104 and provides access to the screw 104 below the object for adjusting from below.

Because the plate does not limit the screw 104 length, this embodiment may use very long screws. This allows a large height adjustability range. The large range permits the support wire length to be selected to be sufficiently long to extend above the object when pulled up. This allows the user to view the picture hanger 300 and easily position the support wire in the wire support. Once the wire is positioned, the object's height is adjusted by turning the screw 104. This is described in more detail in relation to FIGS. 15A and 15B below.

Figure 7:
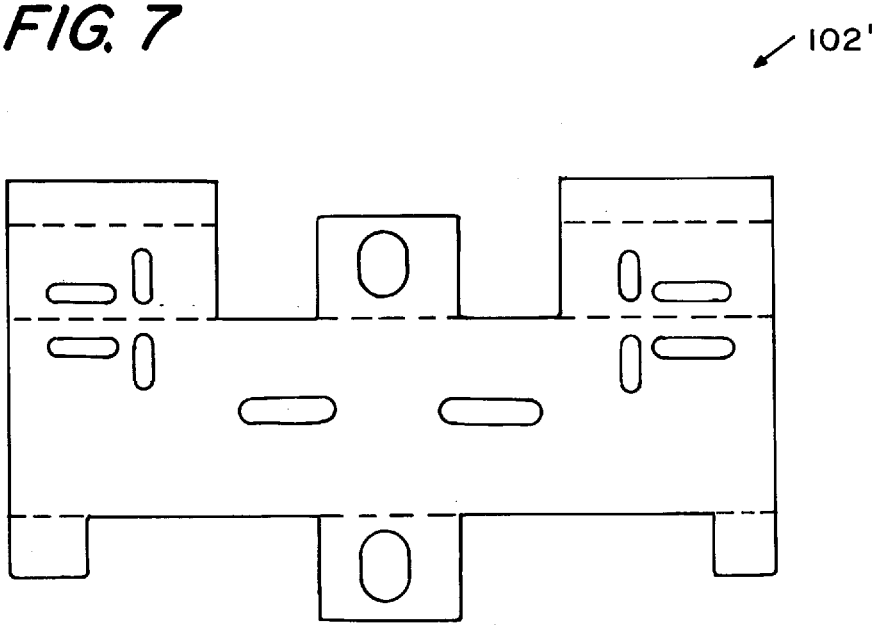
FIG. 7 is a front view of a single sheet of material which may be stamped into the picture hanger of FIG. 6.

FIG. 7 illustrates the single sheet material for the plate 102' shown in FIG. 6.

FIGS. 8 and 9 illustrate a third preferred picture hanger 350 according to the present invention. This embodiment may have the same configuration as shown in FIGS. 1 or 6. The top screw support 112', is recessed and includes a number of openings 352. Preferably, these openings are threaded to receive screws. These openings 352 may be used to mount a picture light or to secure the object. These openings may, for example, receive threaded eyes for receiving a second wire which connects to the object to provide additional safety or security.

Figure 10:
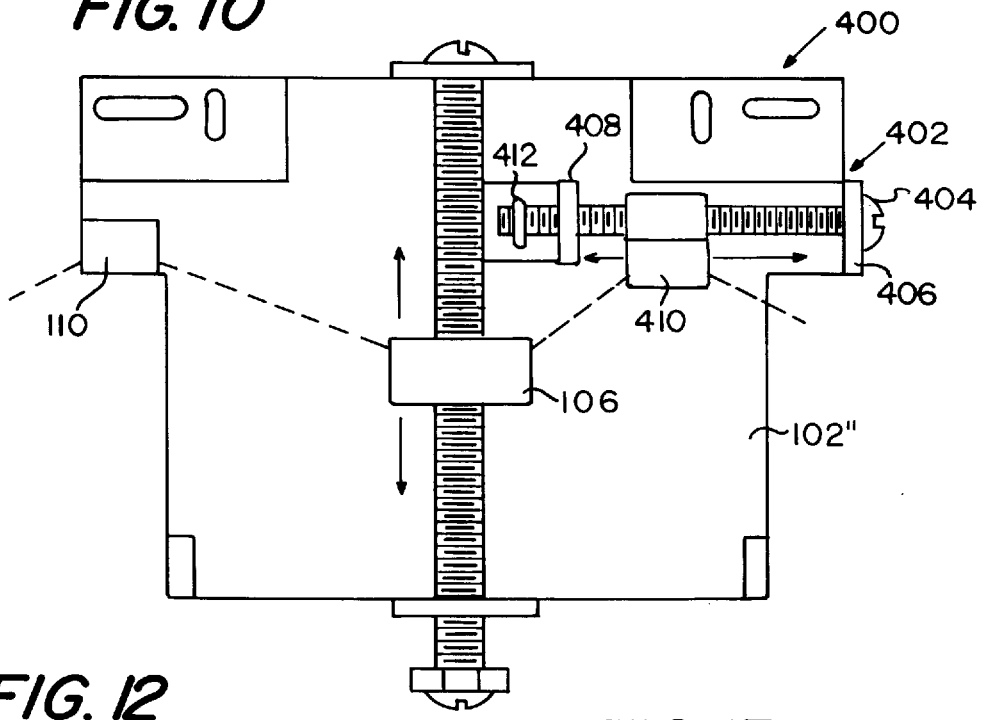
FIG. 10 is a front view of a fourth embodiment of a picture hanger according to the present invention.

FIG. 10 illustrates a fourth preferred picture hanger 400 according to the present invention. This picture hanger 400 has both height and side-to-side adjustability. The picture hanger may have any of the configurations described above, except instead of having two upwardly directed wire supports 110, the plate 102" has only one. Opposite the side having the wire support 110 is a side adjustability mechanism 402.

The side adjustability mechanism 402 includes a horizontal screw 404, a first screw support 406, a second screw support 408, an adjustable wire support 410, and a locked nut 412 on the screw 404. Turning the screw in a first direction (i.e., clockwise) moves the adjustable wire support 410 in a first direction (to the right in this illustration). This changes to location where one "leg" of the "M" which is formed so that the hooks between the wire support 110 and adjustable wire supports 410 move to the right. Turning the screw in a second direction (i.e., counterclockwise) moves the adjustable wire support 410 in a second direction (to the left in this illustration). This changes to location where one "leg" of the "M" is formed so that the leg becomes longer.

Figure 11A:
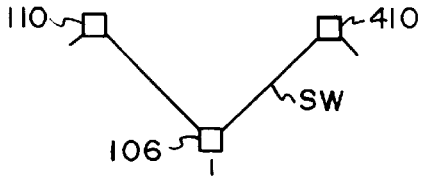
FIGS. 11A, 11B, and 11C illustrate the operation of the picture hanger of FIG. 10.
Figure 11B:
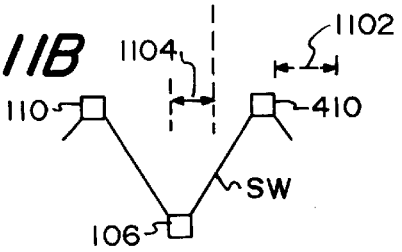
Figure 11C:
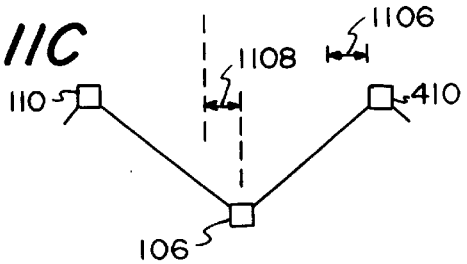

FIGS. 11A–11C illustrate the operation of the side adjustability mechanism. FIG. 11A illustrates the support wire SW in place between wire supports 110, 410 and adjustable hook 106 in an initial position. A dashed line indicates the center position of the wire, which is also the center position of the object. FIG. 11*b* shows the position of the wire SW, wire supports 110, 410, and adjustable hook 106 when the adjustable wire support 410 is moved a distance 1102 to the left. Because the adjustable hook 106 defines the center point of the wire between the wire supports 110, 410, the center point of the wire moves a distance 1104 to the left. FIG. 11C shows the position of the wire SW, wire supports 110, 410, and adjustable hook 106 when the adjustable wire support 410 is moved a distance 1106 to the right (in comparison to FIG. 11A). The center point of the wire moves a distance 1108 to the right.

If only side adjustability is desired, the adjustable channel 106 may be located in a fixed position, with only the side adjustability mechanism being moveable.

Figure 12:
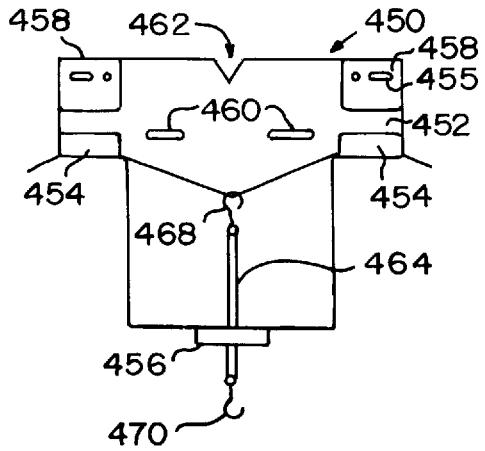
FIG. 12 is a front view of a fifth embodiment of a picture hanger according to the present invention.
Figure 13:
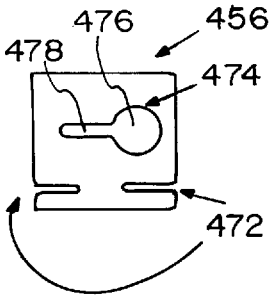
FIG. 13 a top view of a portion of the picture hanger of FIG. 12.

FIGS. 12 and 13 illustrate a fifth preferred picture hanger 450 according to the present invention. The picture hanger 450 includes a plate 452 having a set of upwardly directed wire supports 454, a bottom support 456, and one or more fastening brackets 458 or apertures 460. Preferably, the brackets have horizontally oriented slots 459 and the apertures 460 are horizontally oriented slots. The horizontal slots allow side-to-side adjustability. The plate 452 may also include a center point indicator 462, such as a notch at a center location on the top edge.

The picture hanger 450 also includes a string 464 which connects to the support wire 466. This string 464 (which may also be a wire, chain, or other like device) has a hook 468 at one end and preferably has a grommet, ball, knot, or other device 470 at the other end.

As seen in FIG. 13, the bottom support 456 includes two string receptacles 472 and an aperture 474. The aperture 474 has a wide portion 476 and a narrow portion 478. The purpose of these features will become apparent below.

This picture hanger 450 is used in the following manner. The plate 452 is affixed to the wall with fasteners such as a nail, screw, or molly bolt. The support wire 466 is placed into the upwardly directed wire supports 454. Holding the object away from the wall, the hook 468 of the string 464 is connected to the wire 466 at a location between the wire supports. The other end of the string 464, which is placed through the wide portion 476 of aperture 474, is pulled. Pulling the string pulls down the center of the wire 466, thus raising the object. When the object is at a desired height, the string 478 is pulled into the narrow portion 478 of the aperture. The string extending below the bottom support 456 is wound around the support using the string receptacles 474. Alternatively, the string 468 may be pulled, wrapped around the receptacle 472, and when at the desired length (e.g., the object is at the desired height), the grommet 470 is inserted into the wide portion 476 of the aperture and pulled into the narrow portion 478 to retain it in place. Note that although the object is hanging on the wall when the height is being adjusted, the support wire is supported by the upwardly directed wire supports 454. Thus, the object does not have to be held up while adjusting the height. This embodiment is particularly inexpensive to manufacture.

Figure 14:
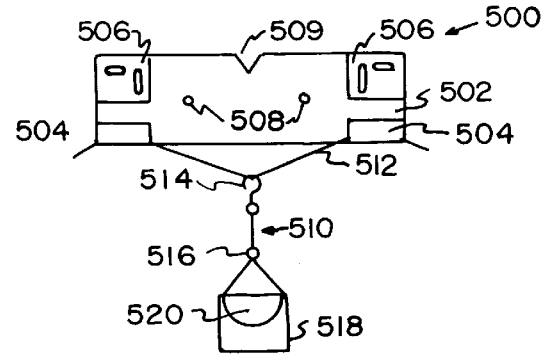
FIG. 14 is a front view of a sixth embodiment of a picture hanger according to the present invention.

FIG. 14 illustrates a sixth preferred picture hanger 500 according to the present invention. The picture hanger 500 includes a plate 502 having a set of upwardly directed wire supports 504, and one or more fastening brackets 506 or apertures 508. The plate 502 may also include a center indicator 509, such as a notch at a center location on the top edge.

The picture hanger 500 also includes a string 510 which connects to the support wire 512. This string 5i0 (which may also be a wire, chain, or other like device) has a hook 514 at one end and preferably has a clasp or other fastening device 516 at the other end. The string 510 may be wrapped around an anchor 518 which has a lip, tongue, or flange 520 and which may be attached to the wall or the back of the object.

To use this picture hanger 500, the string 510 is hooked to the support wire 512, wrapped around the lip 520 of the anchor 518 as many times as desired until the string is at a desired length (e.g., the object is at the desired height). The end of the string is tied or, if the fastener is provided, clipped to itself using the fastening device 516.

Figure 15A:
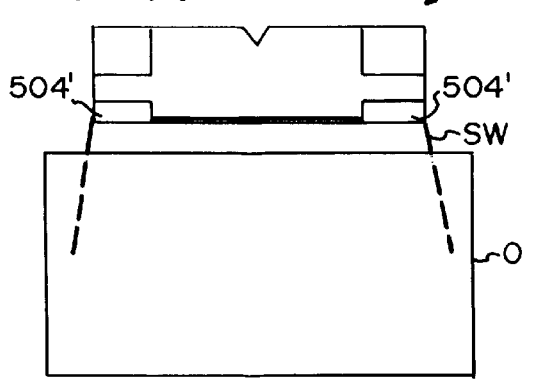
FIGS. 15A and 15B illustrate a preferred operation of the picture hanger of FIGS. 12 and 14.
Figure 15B:
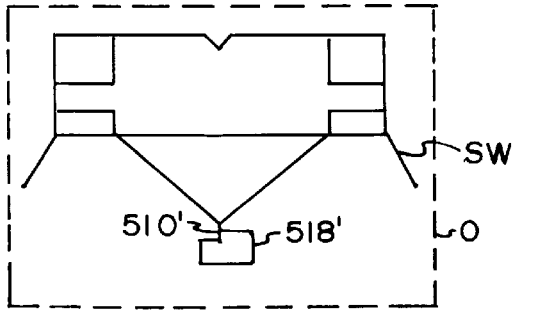

FIGS. 15A and 15B illustrate a preferred method for hanging an object using the picture hanger of FIGS. 12–14. As seen in FIG. 15A, the length of support wire SW is selected to be sufficiently long to extend above the top of object O when pulled up. This provides a full view of the picture hanger 500' and allows the wire SW to be easily placed in the wire supports 504'. This also provides sufficient slack so that the object may easily be pulled away from the wall, providing a user with room to pull the wire SW down (raising the object) and to attach the string 510' to the bottom support or anchor 518'. This provides a less cumbersome, "full view" method for hanging an object than previously possible. When selecting a length for the support wire, it may be preferable to attach the support wire to one side of the object, run the wire through the inventive device (i.e., run it through both wire supports and hook for the devices illustrated in FIGS. 1–11, or run it through the supports for the devices illustrated in FIGS. 12–21). The wire and device are then pushed above the top of the object in a position similar to 15A. The length of the wire is selected so that when the inventive device is adjusted (either by turning the screw or pulling and attaching the wire), the device is hidden behind the object, as seen in FIG. 15B.

The embodiments illustrated in FIGS. 16–22 are particularly useful for hanging heavy or large objects on sheetrock walls. Most sheetrock walls are supported by studs, which are vertical planks of wood or steel. Studs are generally spaced 16" apart. When hanging an object on a sheetrock wall, it is preferably fastened to a stud, because the sheetrock is thin and does not securely hold a nail or other fastener.

Figure 16:
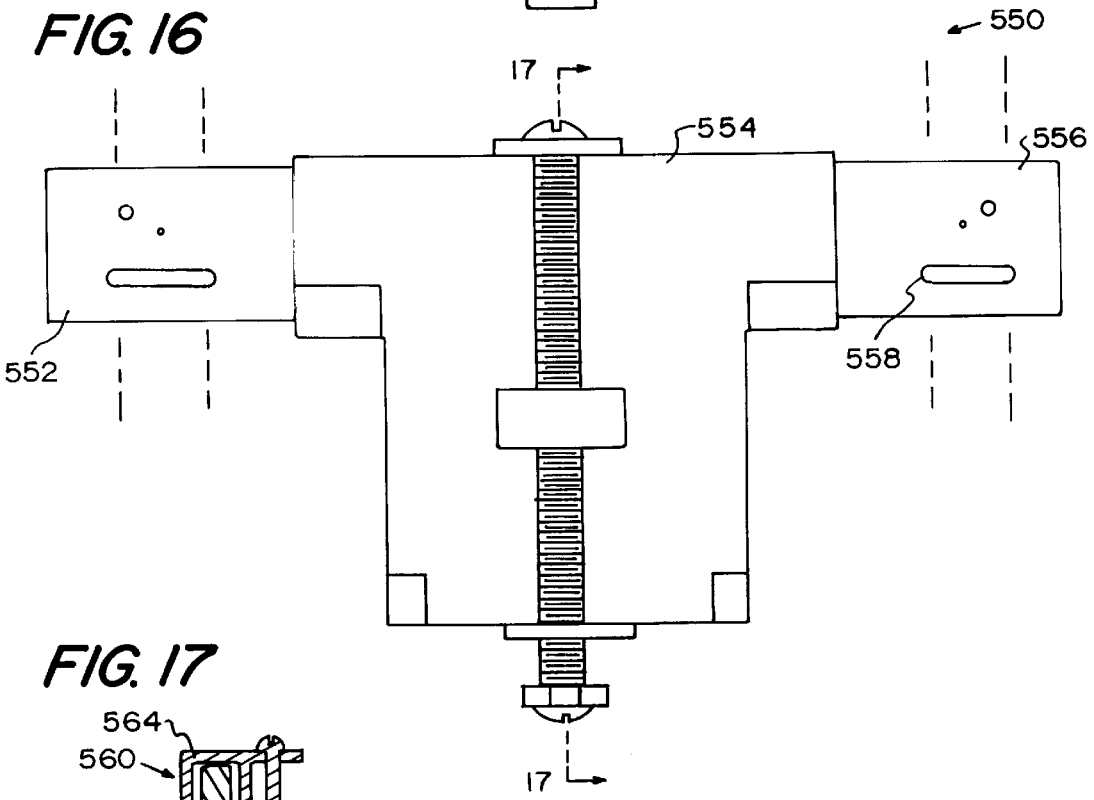
FIG. 16 is a front view of a seventh embodiment of a picture hanger according to the present invention.
Figure 17:
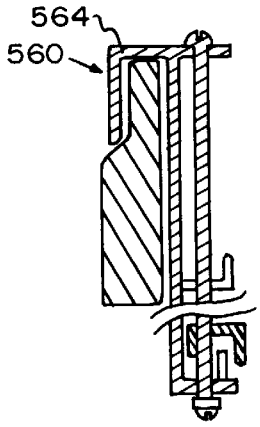
FIG. 17 is a cross-sectional view of the picture hanger of FIG. 16 taken along line 17—17.

FIGS. 16 and 17 illustrate a seventh preferred picture hanger 550 according to the present invention. This picture hanger 550 includes a support bar 552 and a picture hanging device 554.

The support bar 552 may be affixed to two (or more) studs (shown in the figure as dashed lines). The support bar 552 may have a number of apertures 556 or slots 558 for receiving fasteners. Slotted openings provide the support bar 552 with lateral movement to adjust the bar's location while still fastened to the stud. As seen in FIG. 17, the back portion of the bar has a recess 560 running along its top edge.

The picture hanging device 554 is similar to those described above. However, the picture hanging device need not have brackets or apertures for receiving fasteners. Rather, as seen in FIG. 17, the picture hanging device has a tongue or flange 564 which mates with the recess 560 in the bar. The recess/tongue arrangement allows the picture hanger 554 to be located on any horizontal location on the bar 552. Thus, large or heavy objects may be secured to studs in the wall, yet be positioned at locations not centered between the studs. A 24 inch wide object, for example, may be located as much as 6 inches away from the center point between the studs, yet the support bar (which may be 16 inches) does not extend beyond either side of the object.

FIGS. 18–20 illustrate an eighth preferred picture hanger 600 according to the present invention. This picture hanger 600 comprises a U-shaped channel 602 which may be affixed to two (or more) studs (shown in the figure as dashed lines). The channel 602 has a web portion 603 which may have a number of apertures 604 or slots 606 for receiving fasteners. The top and bottom of the channel have a number of holes 608. These holes are adapted to receive hooks or eyes 610 having a threaded portion 611 for fastening to a nut 612, or a screw 614 having an adjustable hook 616 and a locked nut 618, such as a slotted castle nut. Additional hooks or eyes 620 may be connected as optional safety hooks to this bottom of the u-shaped channel 602. Because the holes are located at various locations on the channel 602, a picture hanger made of the hooks 610, screw 614, and adjustable hook 616 and slotted holes 606 may have an object hung from it located at various locations. This allows large or heavy objects to be secured to studs in the wall, yet be positioned at locations not centered between the studs.

FIGS. 21 and 22 illustrate a ninth preferred picture hanger 650 according to the present invention. This picture hanger 650 comprises a U-shaped channel 652 which may be affixed to two (or more) studs (shown in the figure as dashed lines). The channel 652 has a web portion 653 which may have a number of apertures 654 or slots 656 for receiving fasteners. The top of the channel 652 has a number of projections 658. These projections 658 may have one or more recesses adapted to receive a support wire (shown in the figure as a dashed line). The projections 658 also have holes 662 for insertion of a screw 664 having an adjustable hook 666 and a locked nut 668. Because the projections 658 are at various locations on the channel 652, a picture hanger made of the holes 660 and the screw 664 and adjustable hook 666 may have an object hung from it located at various locations. This allows large or heavy objects to be secured to studs in the wall, yet be positioned at locations not centered between the studs.

Figure 23:
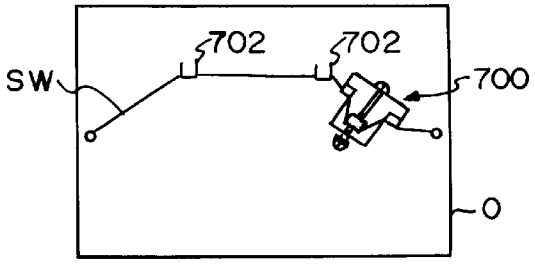
FIG. 23 is back view of the present invention used on an object already hung.
Figure 24:
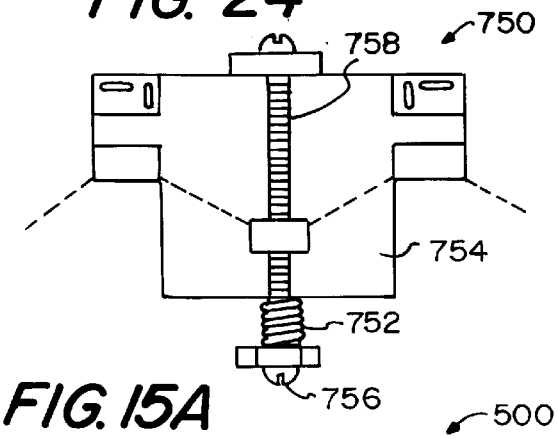
FIG. 24 is a front view of a tenth embodiment of inventive device according to the present invention.

FIGS. 23 and 24 illustrate other applications for the present invention. FIG. 23 shows a picture hanger 700 according to the present invention. An object O is hung with a support wire SW supported by conventional hooks 702. A picture hanger 700 according to the present invention is attached to the wire SW and used to raise the object by shortening the wire. The wire may be shortened by rotating the screw by turning the screw head or the slotted castle nut.

FIG. 24 shows a picture hanger 750 according to the present invention. The picture hanger 750 includes a compressible bias 752, such as a spring, between the plate 754 and the locking nut 756 at the bottom of the screw 758. The configuration absorbs shocks along the wire. This may be used in any application in which shock absorption is desired on a wire, rope, or string.

Each of the embodiments described may be made of any suitably rigid material. Sheet metal, aluminum, brass, or other metals are preferred because they are inexpensive, sturdy, and the picture hangers described may be stamped out of a single sheet. Other materials are also possible. For example, the picture hangers may be made of injection molded plastic, wood, or other suitable material.

The above described embodiments of the invention are intended to be illustrative only. Numerous alternative embodiments may be devised by those skilled in the art without departing from the spirit and scope of the following claims.

I claim:

1. A device for hanging an object on a wall, comprising:

a. a plate;

b. two wire supports connected to opposite sides of the plate, one of the wire supports connected to a side adjustability mechanism; and c. an adjusting hook movably affixed to the plate located between the two wire supports.

2. The device of claim 1, wherein the side adjustability mechanism includes a horizontal screw meshed with the wire support connected to the mechanism.

3. The device of claim 1, further including a safety hook configured to receive a second wire connected to the object.

4. The device of claim 1, wherein the plate further includes fastening brackets, each fastening bracket configured to receive a fastener.

5. The device of claim 4, wherein the fastening bracket includes a horizontally oriented slot.

6. The device of claim 1, wherein the adjusting hook is meshed with a screw rotatably affixed to the plate.

7. The device of claim 6, wherein the screw has a screw head at a fist end and a locked nut at a second end.

8. The device of claim 7, wherein the locked nut is a castle nut.

9. The device of claim 8, wherein the castle nut has a slot to receive a screwdriver.

10. The device of claim 6, wherein the screw is rotatably affixed to the plate by a top screw support and a bottom screw support.

11. The device of claim 10, wherein the plate, the wire supports, and the top and bottom screw supports are stamped from a single sheet of material.

12. A device for hanging an object on a wall, comprising:

a. a plate;

b. a wire support connected to a first side of the plate;

c. a side adjustability mechanism on a second side of the plate, the side adjustability mechanism having a movable wire support; and d. a hook located between the wire support and the side adjustability mechanism.

13. The device of claim 12, wherein the hook is configured to be movable between the wire supports.

14. A method for hanging an object having a support wire attached to the object, the method comprising the steps of:

a. affixing a picture hanger to a wall;

b. placing the wire into wire supports on opposite sides of the picture hanger;

c. placing the support wire into a movable hook located between the wire supports;

d. adjusting a height of the object by changing the height of the movable hook; and e. adjusting a horizontal position of the object by adjusting the horizontal position of the wire supports.

15. The method of claim 14, wherein the step of adjusting includes the step turning a screw from above the object.

16. The method of claim 14, wherein the step of adjusting includes the step tuning a screw from below the object.

17. The method of claim 14, wherein the steps of moving the support wire in a first and in a second direction are performed with the object hanging below the picture hanger.

18. The method of claim 17, wherein the step of adjusting the height further includes raising the height of the object to cover the picture hanger.

19. The method of claim 14, wherein the step of adjusting the horizontal position includes sliding the picture hanger to a side without removing the picture hanger form the wall.

* * * * *